United States Patent [19]

Rives

[11] Patent Number: 4,614,242

[45] Date of Patent: Sep. 30, 1986

[54] BORE HOLE ENLARGING ARRANGEMENT AND METHOD

[76] Inventor: Allen K. Rives, 12211 Carols Way Cir., Houston, Tex. 77070

[21] Appl. No.: 777,737

[22] Filed: Sep. 19, 1985

[51] Int. Cl.[4] ..... E21B 7/28

[52] U.S. Cl. ..... 175/269; 175/285; 175/289

[58] Field of Search ..... 175/263, 269, 267, 284, 175/286, 289, 292, 285

[56] References Cited

U.S. PATENT DOCUMENTS

| | | | |
|---|---|---|---|
| 2,225,165 | 12/1940 | Dunlap, Jr. | 175/286 |
| 2,457,628 | 12/1948 | Baker | 175/285 |
| 3,171,503 | 3/1965 | Shirley | 175/269 |
| 3,386,521 | 6/1968 | Chadderdon et al. | 175/269 |
| 4,458,761 | 7/1984 | Van Vreeswyk | 175/269 |

*Primary Examiner*—Stephen J. Novosad
*Assistant Examiner*—Terry Lee Melius
*Attorney, Agent, or Firm*—Jack W. Hayden

[57] ABSTRACT

A bore hole enlarging method and arrangement for connection with a rotary pipe string includes inner and outer body sections which form a body structure to provide a fluid flow path therethrough for communicating with piston and cylinder means formed between the body sections for receiving drilling fluid to effect telescopic movement between the body sections. Cutter arms are pivotally mounted on the inner body section and a cooperable support arrangement on the cutter arms and outer body section cooperate to expand or move the cutter arms outwardly of the body structure upon telescopic movement of the body sections in one relative direction and assist in attracting the cutter arms when desired.

13 Claims, 5 Drawing Figures

FIG. 1
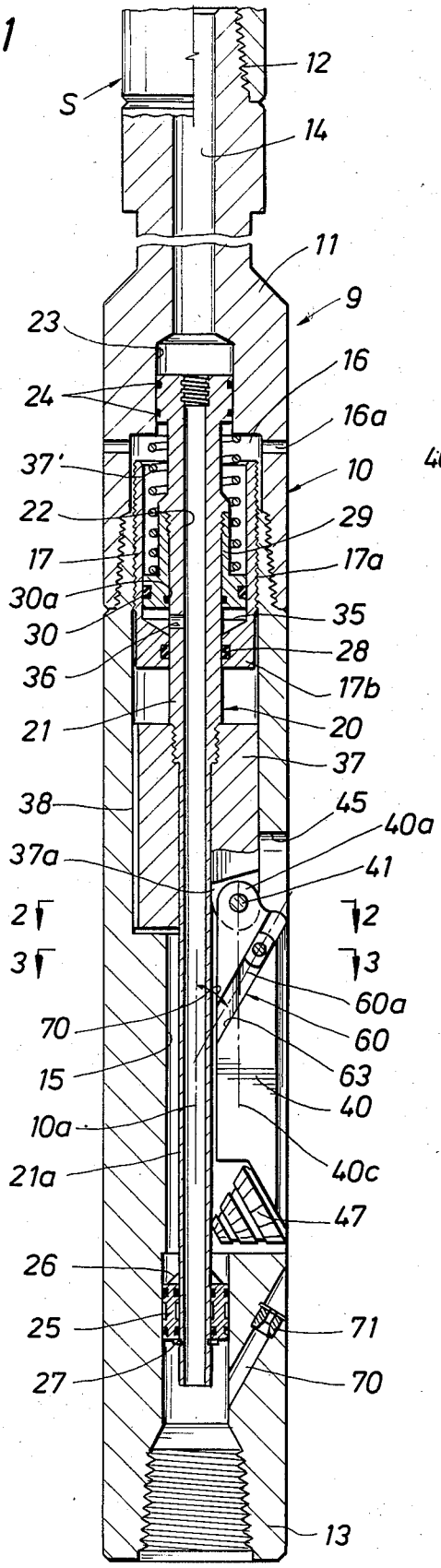
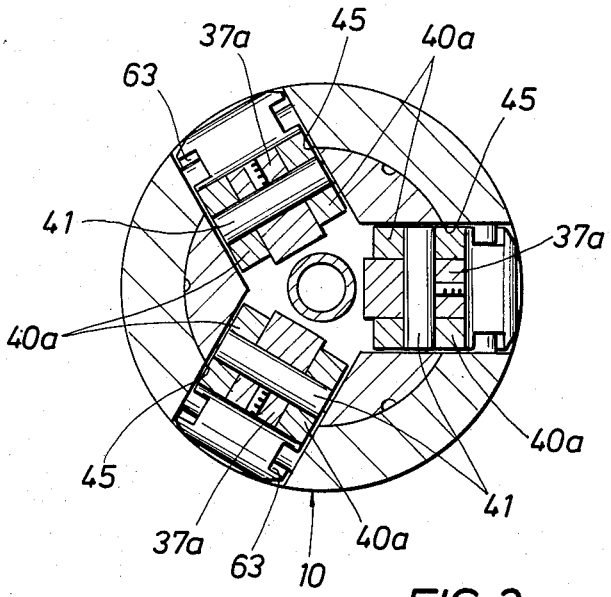
FIG. 2
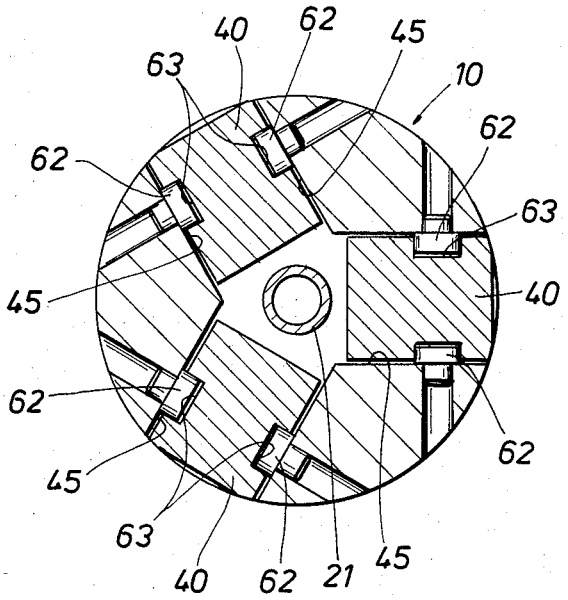
FIG. 3

BORE HOLE ENLARGING ARRANGEMENT AND METHOD

BACKGROUND OF THE INVENTION

1. Field of the Invention

This invention relates to a hole enlargement arrangement and method of use.

2. Description of the Prior Art

Various types of hole enlargement arrangements have been heretofore employed and are currently in use. In the devices with which applicant is familiar, a body structure formed of inner and outer body sections has cutter arms pivotally secured on the outer body section and a piston and cylinder means defined between the inner and outer body sections receive hydraulic fluid to effect telescopic movement of the body sections in one relative direction whereupon a cam surface mechanically engages and forces the cutter arms out to underreaming or bore hole enlarging position.

After the underreaming operation is completed, the cutter arms of the prior art devices are generally then retracted by raising the operating string on which the body structure is supported so that the expanded or projecting arms engage the shoulder formed at the juncture of the upper end of the enlarged underreamed portion with the smaller bore. Continued raising of the operating string exerts a force on the extended cutter arms to endeavor to force the arms inwardly to retracted position relative to the body structure.

If mud or some other obstruction prevents relative longitudinal telescopic movement between the inner and outer body sections so that the cutter arms can retract, then it has been generally customary in such circumstances to merely continue exerting a pull on the operating string until some portion of the bore hole enlarging structure breaks so that it then may be withdrawn from the well bore. Also, it can be appreciated that if the structure of the prior art malfunctions or breaks so that the inner and outer bodies are locked against telescopic movement while the arms are in extended position, then the arms again are forced to collapsed position by pulling up on the operating string to try to force them to retracted position, or to break whatever structure may be necessary to enable the prior art bore hole enlarging arrangement to be withdrawn from the bore hole.

When the arms of the bore hole enlarger are extended during drilling operations to underream or drill an enlarged portion in a bore hole, there are various forces that act upon the cutter arms during the bore hole enlarging operations. Some of such forces include an upwardly directed force on the outer projecting end of the arm due to the reaction from the weight of the operating string during drilling operations. There also are other forces. For example, there is a force which tends to move the cutter arms back towards retracted position due to the angle of the hole, a force due to the reaction from rotation while drilling the formation which tends to retract the cutter arms inwardly, and a force which arises from rotation during bore hole enlarging operations so that formation pressure against the leading edge of the arm along its axial extent tends to flex the cutter arm.

In prior art devices, these forces are transmitted from the cutter arms to the pivot arrangement of the cutter arms on the body structure and cam surface relied upon to move and maintain the cutter arms in extended cutting position. In some circumstances these forces may be substantial and in some instances damage or break components of the bore hole enlarger.

The present invention provides an arrangement that assists in overcoming the above and other problems. The cutter arms are pivotally mounted on the inner body structure and a cooperative support arrangement on the outer body section and cutter arms is employed to assist in moving or expanding the cutter arms to expanded cutter position and to assist in retracting the arms when the cutting operation is over. The cooperating support arrangement also assists in better distributing the loads and forces employed during the bore hole enlarging operation and also increases the mechanical advantage tending to maintain the cutter arms in expanded position during bore hole enlarging operations.

Other objects and advantages of the present invention will become apparent from a consideration of the following description and drawings.

BRIEF DESCRIPTION OF THE DRAWINGS

FIG. 1 is a longitudinal sectional view illustrating a preferred embodiment of the bore hole enlarger with the cutter arms in retracted position;

FIG. 2 is a sectional view on the line 2—2 of FIG. 1 to better illustrate certain structural details;

FIG. 3 is a sectional view on the line 3—3 of FIG. 2 to illustrate an embodiment of the cooperative means on the outer body section and the cutter arms;

DESCRIPTION OF THE PREFERRED EMBODIMENT

Figure 4:
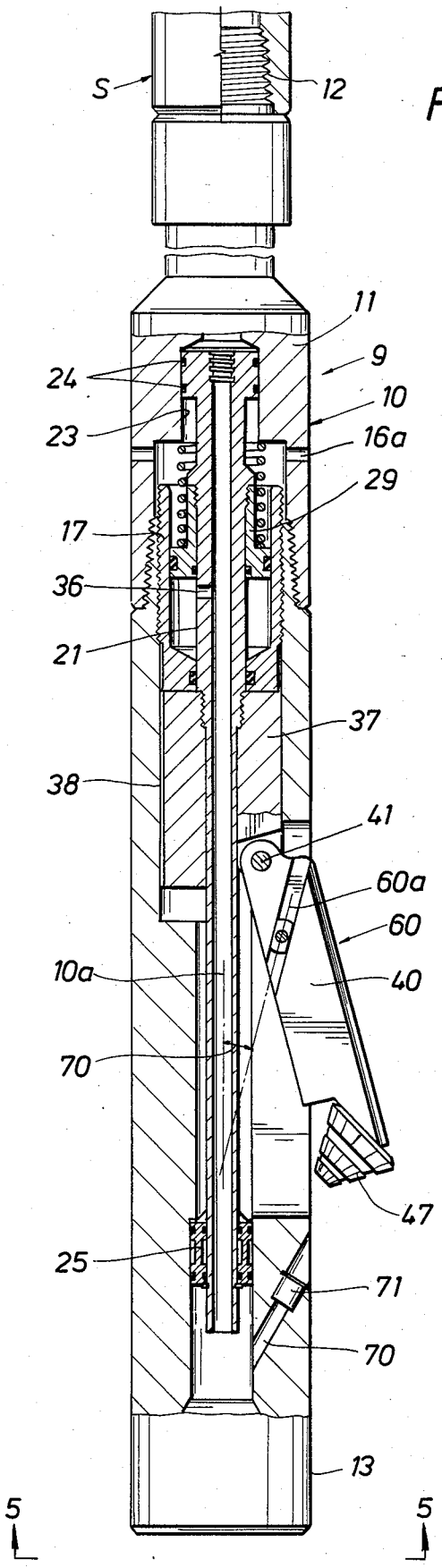
FIG. 4 is a longitudinal sectional view, partly in elevation, illustrating the relationship of the bore hole expander arrangement when the cutter arms are extended.
Figure 5:
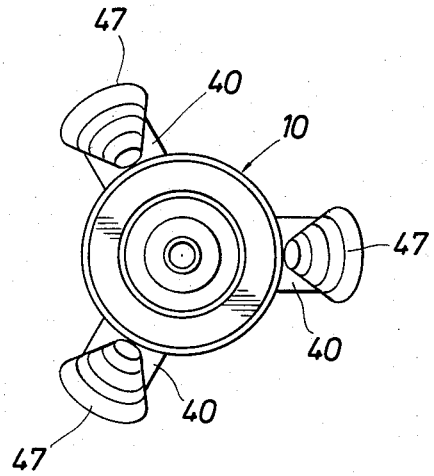
FIG. 5 is an end view on the line 5—5 of FIG. 4.

Attention is first directed to FIG. 1 of the drawings wherein the reamer or hole enlarger of the present invention is referred to generally by the numeral 9. A body structure referred to generally at 10 is formed by a longitudinally extending outer body section 11 which receives therein an inner body section referred to generally at 20.

The outer body section 11 is provided with a threaded pin end 12 and a threaded box end 13 at the opposite end of the body structure 10 whereby the body structure 10 may be threadedly engaged with a rotary well string S for lowering in a well bore to enlarge, or underream a portion of the well bore.

The inner body section 20 includes a tube 21 extending longitudinally of the outer body section 10 as shown. The tube 21 includes a bore 22 therethrough which communicates with the bore 14 in the outer body structure for forming a fluid flow path that communicates with the connected well string for supplying drilling fluid to actuate the underreamer 9 as will be described.

The tube 21 is received within the counterbore 23 at the upper end of the outer body section 11 and is provided with seal means 24 for sealably engaging therewith. A chamber 16 is formed in the outer body section 11 and extends from the lower end of the counterbore 23 to the upper end of the longitudinal passage 15 in which is received the lower extension **21*a* of the tube 21 as shown. A seal bushing 25 is mounted on the tube extension 21*a* in any suitable manner such as by the annular shoulder or projection 26 on the tube 21***a* and the snap ring 27 which abuts the lower end of the seal bushing 25 to secure it with the tube extension 21*a*. The seal bushing 25 seals between the tube extension 21*a* and the passage 15.

The outer body section 11 is provided with passages 16*a* for communicating the well bore with the interior of chamber 16 for equalization of pressure therebetween. A cylindrical member 17 is secured with the outer wall section of outer body section 11 with chamber 16 as illustrated in any suitable manner such as by the threads 17*a* which threadedly engage the cylindrical walls of the cylindrical member 17 to the outer body section 10 within the chamber 16. The lower end 17*b* of cylindrical number 17 is closed as shown.

The longitudinal tube 21 forming part of inner body section 20 extends through the closed end 17*b* of cylindrical member 17 as shown and is sealably engaged as shown at 28 with the lower closed end 17*b* of the cylindrical member 17. A piston member 29 is threadedly secured to the tube 21 and is thereby positioned within the cylindrical member 17. Annular seal 30 on piston member 29 engages the cylindrical walls of the cylindrical member 17 and seal 30*a* sealably engages piston member 29 on tube 21. This defines a means including the piston arrangement 29 and cylinder means 17 to effect telescopic movement of said body sections in one relative direction. More particularly, the space between the lower end of piston member 29 and the closed end 17*b* of cylindrical member 17 defines between the inner body section 20 and outer body section 11 a chamber 35 for receiving from the well string pressured drilling fluid which flows through passage 14 in body structure 10, passage 22 and port 36 in tube 21 to act on the piston and cylinder means to effect telescopic movement of the outer body section 11 and inner body section 20 in one relative direction to move the cutter arms 40 from the retracted position shown in FIG. 1 to the expanded position shown in FIG. 4.

Suitable spring means 37' abut at its upper end against the shoulder formed by the juncture of the chamber 16 with the counterbore 23. The lower end of spring 37' rests on the top side of the piston means 29 to tend to urge the inner body section 20 and piston means downwardly to a position to tend to maintain the cutter arms 40 in retracted position. Stated differently, such spring means 37' inhibits telescopic movement between the inner body section 20 and outer body section 10 in said one relative direction.

To assist in maintaining alignment as well as providing other functions, a yoke member 37 is threadedly secured to the tube 21 as shown in the drawings and extends longitudinally in the lower part of the chamber 16 to accommodate relative longitudinal movement between the inner and outer body sections 20 and 11 while supporting and stabilizing the body structure during underreaming, or well bore enlarging operations. Suitable longitudinal groove means 38 are provided in the yoke member 37 to enable fluid pressure exteriorly of the body structure 9 to communicate with the chamber immediately above the yoke member 37 and equalize with that existing in the well bore, thus accommodating unrestricted longitudinal movement between the inner and outer body sections 20 and 11, respectively.

The yoke member 37 also supports the cutter arms 40, three of which are illustrated in the embodiment in the drawings. The cutter arms 40 are arranged in longitudinal slots 45 which are circumferencially spaced on the outer body 10 as shown in FIG. 2 and 3 of the drawings.

The cutter arms 40 are pivotally connected to the inner body 20 by means of the pivot pins 41 extending through the spaced upper ends 40*a* of the cutter arms 40 which ends 40*a* straddle circumferentially spaced, depending projections 37*a* formed on the lower end of the yoke member 37 as better illustrated in FIGS. 1 and 2 of the drawings.

The lower end of each of the cutter arms 40 is provided with a drill bit 47 rotatably supported on the cutter arm in any manner well known in the art.

Heretofore, some difficulty has been encountered in conducting underreaming operations with devices of the prior art due to the forces and loads imparted to the cutter arms and body structure during the underreaming operations.

In an attempt to overcome these problems, the cutter arms of the present invention are not only pivotally mounted and supported on the inner body section 20, but cooperating means on the outer body section 11 and cutter arms 40 cooperate to support the cutter arms on the outer body section 11 and assist in moving the cutter arms towards expanded and retracted position. Such arrangement also provides a mechanical advantage which advantage becomes greater as the cutter arms are moved toward expanded position and which advantage is maintained during bore hole enlargement operations to aid in maintaining the tool in open position, that is, to maintain the cutter arms 40 expanded during bore hole enlarging operations and to better absorb the loads and forces encountered during such operation.

One arrangement of such cooperating means is illustrated in the drawings and is shown as including the arrangement generally referred to at 60 which enables the outer body 11 to support the cutter arms 40 as they are expanded, and during bore hole enlargement operations, as well as assisting the cutter arms 40 in moving towards retracted position. After bore hole enlargement operations have been completed, the body structure 9 is elevated to engage the cutter arms 40 against the ledge formed by the enlargement in the bore hole to assist in retracting the arms back into the body structure 9 as shown in FIG. 1 of the drawings. The arrangement 60 provides an interfitting arrangement and includes suitable means on the outer body section 10 which moveably interfits with each cutter arm 40 and assists in urging and moving the cutter arms 40 to retracted position, as opposed to merely breaking the cutter arms.

In the embodiment illustrated in the drawings, such interfitting arrangement is shown as including projecting means 62 mounted on the outer body section 11 and which projects inwardly into the longitudinal slots 45 as better illustrated in FIG. 3 of the drawings. A groove means 63 is formed on each side of and extends diagonally relative to the longitudinal axis, represented at 40*c*, of each cutter arm 40 and receives the projections 62 therein as shown.

When the cutter arms 40 are in retracted position as shown in FIG. 1, the angle represented at 70 between the longitudinal axis of the body 10*a* structure 10 and the longitudinal axis 60*a* of the arrangement 60 (defined by the longitudinal axis of the groove means 63) is larger than the same angle represented at 70 when the cutter arms 40 are moved to expanded position as shown in FIG. 4. Since the angle 70 is smaller when the cutter arms 40 are moved to expanded position for performing underreamer or bore hole enlargement operations, the mechanical advantage of the present invention becomes larger when the arms are moved to expanded position and thereby provides a structure which tends to maintain the cutter arms 40 in expanded position during well bore enlarging operations.

The cylinder means 17 provide a means to adjustably limit the telescopic movement of the body sections and thereby provides a range of hole enlargement diameters that may be attained with a particular body size structure. For example, and by illustration only, assume that the body structure 10 is 11¾" O.D. This same body size, by adjusting the longitudinal position of the cylinder member 17 in chamber 16 can be used to underream a 17½" hole, 20", 22½" or 24" hole, or any desired size from 17½" through 24" O.D.

Where it is desired to perform a larger diameter underream, a larger body size would be employed to cover a range of larger underream diameters. This overcomes some of the problems encountered with prior art devices which require that some component of the underreamer or bore hole enlarger be changed for each hole diameter desired. In the present invention, merely by threading the cylinder means 17 longitudinally of the chamber 16 and body structure 10, the desired underream outer diameter may be attained. The longitudinal position of the cylinder means 17 acts as a stop means for the upper end of the yoke means 37 and thus determines the amount of extension of the cutter arms 40 and hence the outer diameter of the enlargement or underreaming portion to be formed.

The upward end force encountered by the drill cones 47 during underreaming operations reacts to assist in keeping the arms expanded during the underreaming operations by reason of the foregoing construction of the present invention. Also, where the present invention is used to underream or enlarge in a high angle well bore hole, and with the arms engaging the low side of the well bore, there is a tendency for the radial load to close or retract the arms of some prior art devices; however the force acting on the end of the cones in an upward direction, as the underreaming device moves downwardly during the underreaming operations and arrangement 60 assists in keeping the arms extended and resists the radial closing of the arms.

The structural arrangement of the present invention as shown in the drawings provides as much body support as possible to the arms since the arms are supported by both the inner and outer body structures in their extended position which inhibits wobbling as well as wear on the components of the invention, which wear can be aggravated by the presence of mud encountered during the enlarging operation that may act to grind or wear down components of some prior art devices more readily than that which would occur with the present invention due to the stabilizing effect of the yoke member 37 and of the interfitting support arrangement 60 between the outer body and the cutter arms 40.

As previously noted, after the underreaming operation is completed, retraction of the cutter arms 40 is accomplished by lifting or raising the pipe string in the well bore on which the body structure 10 is carried so that the cutter arms 40 in their extended position engage the upper end of the completed underreamed or enlarged portion in the well bore. In prior devices where it has been impossible to effect retraction of the arms by such engagement and subsequent pulling on the well string, it has been necessary to break some tool component by exerting a continued upward force on the well string so that the underreaming device thereafter might be recovered from the well bore.

However, in the present invention, even though the body structure may be immersed in mud, the force applied to the cutter arms 40 by engaging them with the ledge at the upper end of the enlargement acts to move the cooperating means 60 between the outer body section 10 and the cutter arms from the position shown in FIG. 4 to the position shown in FIG. 1. In this instance also, the mechanical advantage is increased as the cutter arms move from expanded to retracted position since the angle 70 increases from that shown in FIG. 4 to that shown in FIG. 1.

A passage 70 in outer body section 11 adjacent the lower end thereof is provided with a carbide nozzle insert 71 and retained in position in passage 70 by means well known in the art. This enables drilling fluid to be conducted from the flow passage in the body structure 10 and directed against the cones 47 to assist in removing cuttings and debris therefrom during underreaming operations.

After underreaming operations are completed, the pump pressure acting on the drilling fluid is relieved and when weight of the well string is removed from body 10 spring 37' tends to move the inner body section 11 back to the position shown in FIG. 1. However, the arms 40 may be engaged with the shoulder at the top of the underream section and by applying a pull on the well string, the cooperating arrangement 60 assists in moving the cutter arms 40 to retracted position.

The foreclosing disclosure and description of the invention are illustrative and explanatory thereof, and various changes in the size, shape and materials as well as in the details of the illustrated construction may be made without departing from the spirit of the invention.

What is claimed is:

1. A bore hole enlarging arrangement for connection with a rotary pipe string having a fluid flow path comprising:

a body structure including inner and outer telescopic body sections;

expansible and retractable cutter arms pivotally supported on said inner body section;

said outer body section having circumferentially spaced, logitudinal slots for receiving said cutter arms;

longitudinally extending groove means with projection means interfitting therewith for connecting said cutter arms with said outer body section to pivotally support said cutter arms in the longitudinal slots of said outer body section; and fluid actuated means to move said inner body section upwardly relative to said outer body section and thereby effect relative movement between said projection means and said groove means to expand said cutter arms outwardly of said outer body section.

2. The arrangement of claim 1 including means to inhibit telescopic movement of said body sections in said one relative direction.

3. The arrangement of claim 1 wherein said last named means therein includes piston and cylinder means defined between said inner and outer body sections and passage means in said body structure for conducting drilling fluid to said piston and cylinder means to effect upward movement of said inner body section.

4. The arrangement of claim 1 including means adjustable longitudinally on said outer body section and through which said inner body section extends to adjustably limit the telescopic movement of said body sections and thereby provide a range of hole enlargement diameters that may be attained with said body structure.

5. The invention of claim 1 wherein said longitudinally extending groove means extends diagonally relative to the longitudinal axis of said cutter arms.

6. The arrangement of claim 1 including means to move said inner body section downwardly relatively to said outer body section and thereby effect relative movement between said groove means and projection means to retract said cutter arms toward said longitudinal slots in said outer body section.

7. The arrangement of claim 1 including means to move said cutter arms from expanded to retracted position.

8. A hole boring enlarging arrangement for connection with a rotary pipe string having a drilling fluid flow path comprising:

a body structure including inner and outer telescopic body sections;

expansible and retractable cutter arms pivotally mounted on said inner body section;

said outer body section having circumferentially spaced, logitudinal slots for receiving said cutter arms;

groove means on opposed sides of each of said cutter arms and projection means on said outer body section extending into said longitudinal slots and within said groove means to pivotally support said cutter arms in the longitudinal slots of said outer body section; and fluid actuated means to move said inner body section upwardly relative to said outer body section and thereby effect relative movement between said projection means and said groove means to expand said cutter arms outwardly of said outer body section.

9. The arrangement of claim 8 including means to move said inner body section downwardly relatively to said outer body section and thereby effect relative movement between said groove means and projection means to pull said cutter arms toward said longitudinal slots in said outer body section.

10. The invention of claim 8 wherein said groove means in said cutter arms extend diagonally of the longitudinal axis of said cutter arms.

11. A method of conducting bore hole enlarging operations with a rotary pipe string that carries a body structure having a fluid flow path therethrough, the body structure including inner and outer telescopic body sections with expansible and retractable cutter arms pivotally mounted on each the inner and outer body section for movement to expanded and retracted position, comprising the steps of:

lowering the rotary pipe string and body structure to position in the bore hole;

circulating fluid in the body structure to effect upward movement of the inner body section relative to the outer body section and thereby expand the cutter arms and to decrease the angle formed between the longitudinal axis of the body structure and the longitudinal axis of the pivot mounting of the cutter arms on the outer body section for increasing the mechanical advantage tending to maintain the cutter arms expanded during bore hole operations.

12. In a bore hole enlarging arrangement including a body structure for connection with a rotary pipe string, the body structure having a drilling fluid flow path therethrough, inner and outer telescopic body sections which define piston and cylinder means between said body sections for receiving drilling fluid to effect telescopic movement in one direction between said body sections whereby cutter arms supported on the body structure may be expanded, the improvement comprising:

pivot means pivotally mounting the cutter arms on said inner body section; and cooperating means on the outer body section and the cutter arms operable upon telescopic movement of said body section in said one relative direction to decrease the angle formed between the longitudinal axis of the body structure and a longitudinal axis of said cooperating means to thereby increase the mechanical advantage tending to maintain the cutter arms expanded during bore hole enlarging operations.

13. A method of forming an enlargement in a bore hole with a shoulder at the juncture of the enlargement and bore hole by lowering into the bore hole a rotary pipe string that carries a body structure having a fluid flow path therethrough, the body structure including inner and outer telescopic body sections with expansible and retractable cutter arms pivotally mounted on each the inner and outer body section for movement to expanded and retracted positions, comprising the steps of:

lowering the rotary pipe string and body structure to position in the bore hole;

circulating fluid in the body structure to effect upward movement of the inner body section relative to the outer body section and thereby expand the cutter arms to form the enlargement upon rotation of the pipe string; and elevating the well string to engage the cutter arms with the enlargement shoulder and to move the inner body section down and thereby pull the cutter arms to retracted position.

* * * * *